US010958044B1

(12) United States Patent
Kawashima et al.

(10) Patent No.: US 10,958,044 B1
(45) Date of Patent: Mar. 23, 2021

(54) SPARK PLUG

(71) Applicant: NGK Spark Plug Co., Ltd., Nagoya (JP)

(72) Inventors: Yusuke Kawashima, Nagoya (JP); Naoki Nishio, Nagoya (JP); Yusuke Tanahashi, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 17/038,401

(22) Filed: Sep. 30, 2020

(30) Foreign Application Priority Data

Nov. 14, 2019 (JP) ..... JP2019-206193

(51) Int. Cl.
*H01T 13/16* (2006.01)
*H01T 13/20* (2006.01)

(52) U.S. Cl.
CPC ..... *H01T 13/16* (2013.01); *H01T 13/20* (2013.01)

(58) Field of Classification Search
CPC ..... H01T 13/16; H01T 13/20
See application file for complete search history.

(56) References Cited

U.S. PATENT DOCUMENTS 10,128,638 B1 * 11/2018 Kawai ..... H01T 13/36
2017/0346259 A1 * 11/2017 Kawai ..... H01T 13/36
2018/0019578 A1 * 1/2018 Mukoyama ..... H01T 13/34
2018/0366917 A1 * 12/2018 Ozeki ..... H01T 13/20

FOREIGN PATENT DOCUMENTS

JP 2005-190762 A 7/2005

* cited by examiner

*Primary Examiner* — Kevin Quarterman
(74) *Attorney, Agent, or Firm* — Kusner & Jaffe

(57) ABSTRACT

In the spark plug, an insulator is held by a metal shell via a packing. The packing includes a base material and a metal layer formed on a surface of the base material. In a cross section including the axial line, of distances between end points of the metal layer on a first contact surface of the insulator that contacts with the metal layer and first points which are intersections of the first contact surface and first perpendiculars extending to the first contact surface from first corners at which a first surface and third surfaces of the base material intersect each other is longer than a thickness of the metal layer at a middle position on the third surface that corresponds to half a length measured along the third surface.

4 Claims, 7 Drawing Sheets

SPARK PLUG

FIELD OF THE INVENTION

The present invention relates to a spark plug, and in particular, relates to a spark plug with a packing interposed between a metal shell and an insulator.

BACKGROUND OF THE INVENTION

In a spark plug with a packing interposed between a metal shell and an insulator, a feature of providing metal layers on surfaces of the packing that contact with the metal shell and the insulator, is known (Japanese Laid-Open Patent Publication No. 2005-190762).

Problems to be Solved by the Invention

In recent years, with engine performance enhancement, combustion efficiency improvement, and the like, the amount of heat that the insulator receives from combustion gas has been increasing. Therefore, in order to prevent pre-ignition in which the insulator acts as an ignition source, it is required to reduce the thermal resistance of the packing so as to increase the amount of heat flow transferring from the insulator through the packing to the metal shell.

SUMMARY OF THE INVENTION

The present invention has been made to meet the above requirement, and an object of the present invention is to provide a spark plug that enables reduction in the thermal resistance of a packing.

Means for Solving the Problems

To attain the above object, a spark plug of the present invention includes: an insulator extending along an axial line from a front side to a rear side and having a step portion of which an outer diameter reduces toward the front side in the axial-line direction; and a cylindrical metal shell having, on an inner circumference thereof, a ledge portion of which an inner diameter reduces toward the front side in the axial-line direction, the metal shell holding the insulator from an outer circumferential side in a state in which the step portion is engaged with the ledge portion via a packing. The packing includes a base material, and a metal layer formed on a surface of the base material and contacting with the insulator and the metal shell. The base material includes a first surface where a part of the metal layer that contacts with the insulator is formed, a second surface on a side opposite to the first surface, and third surfaces connecting the first surface and the second surface. In a cross section including the axial line, of distances between end points of the metal layer on a first contact surface of the insulator that contacts with the metal layer and first points which are intersections of the first contact surface and first perpendiculars extending to the first contact surface from first corners at which the first surface and the third surfaces intersect each other, a shorter distance positioned on the front side in the axial-line direction is defined as distance A1, and a shorter distance positioned on the rear side in the axial-line direction is defined as distance A2. At least one of the distance A1 and the distance A2 is longer than a thickness of the metal layer in a direction perpendicular to the first perpendicular at a middle position on the third surface that corresponds to half a length measured along the third surface from the first corner to a second corner at which the second surface and the third surface intersect each other, on a side where the corresponding one of the distance A1 and the distance A2 is measured.

Effects of the Invention

In the spark plug according to a first aspect, in the cross section including the axial line, at least one of the distances A1, A2 between the first points and the end points of the metal layer on the first contact surface is longer than the thickness of the metal layer at the middle position on the third surface. Therefore, the area of the metal layer that contacts with the insulator becomes large accordingly. The thermal resistance of the metal layer is proportional to the thickness of the metal layer and inversely proportional to the area and the thermal conductivity of the metal layer. Therefore, it is possible to reduce the thermal resistance of the packing by increasing the area of the metal layer that contacts with the insulator, without changing the thickness or the thermal conductivity of the packing.

In the spark plug according to a second aspect, in the cross section including the axial line, at least one of the distances A1, A2 is longer than the distance C between the first surface and the first contact surface. Since the distance C is shorter, the thermal conductivity can be expected to be improved owing to reduction in the thickness of the metal layer between the first surface of the base material and the insulator and decrease in voids and the like included in the metal layer. Thus, in addition to the effects of the first aspect, the thermal resistance of the packing can be further reduced.

In the spark plug according to a third aspect, in the cross section including the axial line, at least one of the distances B1, B2 between the second points and the end points of the metal layer on the second contact surface is longer than the thickness of the metal layer at the middle position on the third surface. Therefore, the area of the metal layer that contacts with the metal shell can be increased accordingly. Since the area of the metal layer that contacts with the metal shell is increased, in addition to the effects of the first or second aspect, the thermal resistance of the packing can be further reduced.

In the spark plug according to a fourth aspect, in the cross section including the axial line, at least one of the distances B1, B2 is longer than the distance D between the second surface and the second contact surface. Since the distance D is shorter, the thermal conductivity can be expected to be improved owing to reduction in the thickness of the metal layer between the second surface of the base material and the metal shell and decrease in voids included in the metal layer. Thus, in addition to the effects of the third aspect, the thermal resistance of the packing can be further reduced.

DETAILED DESCRIPTION OF THE INVENTION

Figure 1:
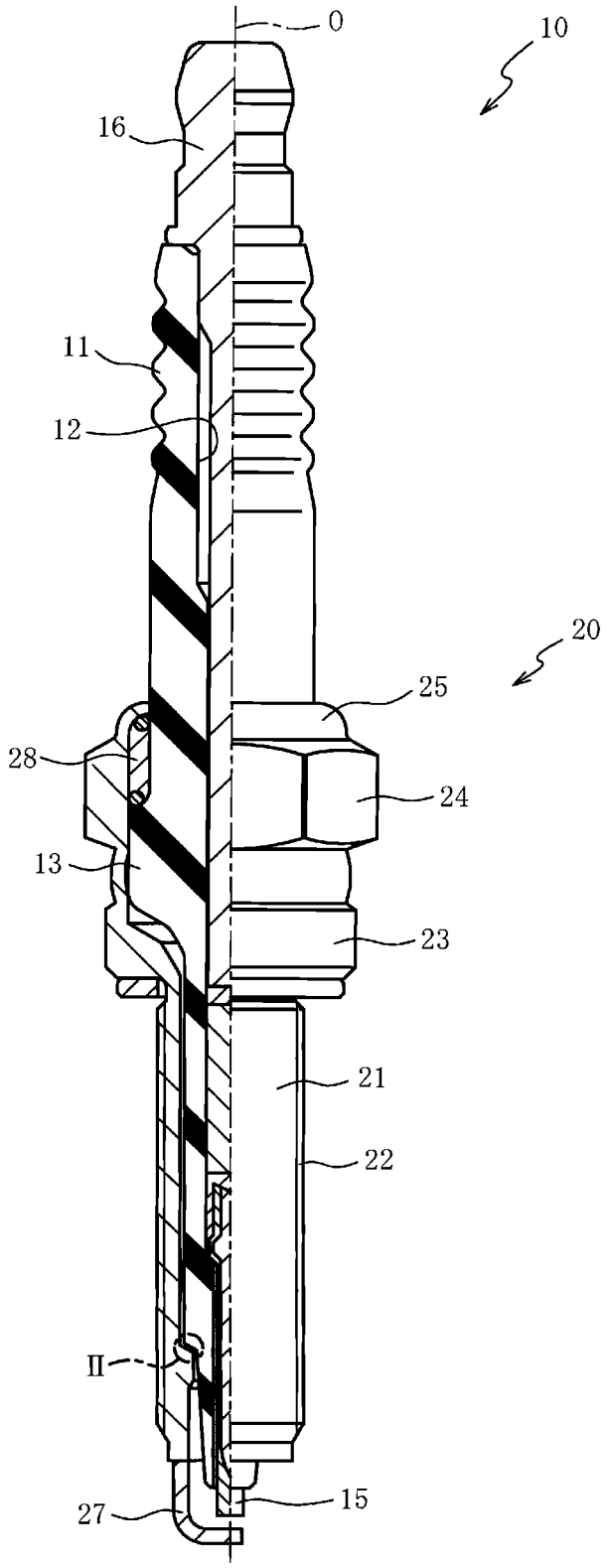
FIG. 1 is a half-sectional view of a spark plug according to the first embodiment.
Figure 2:
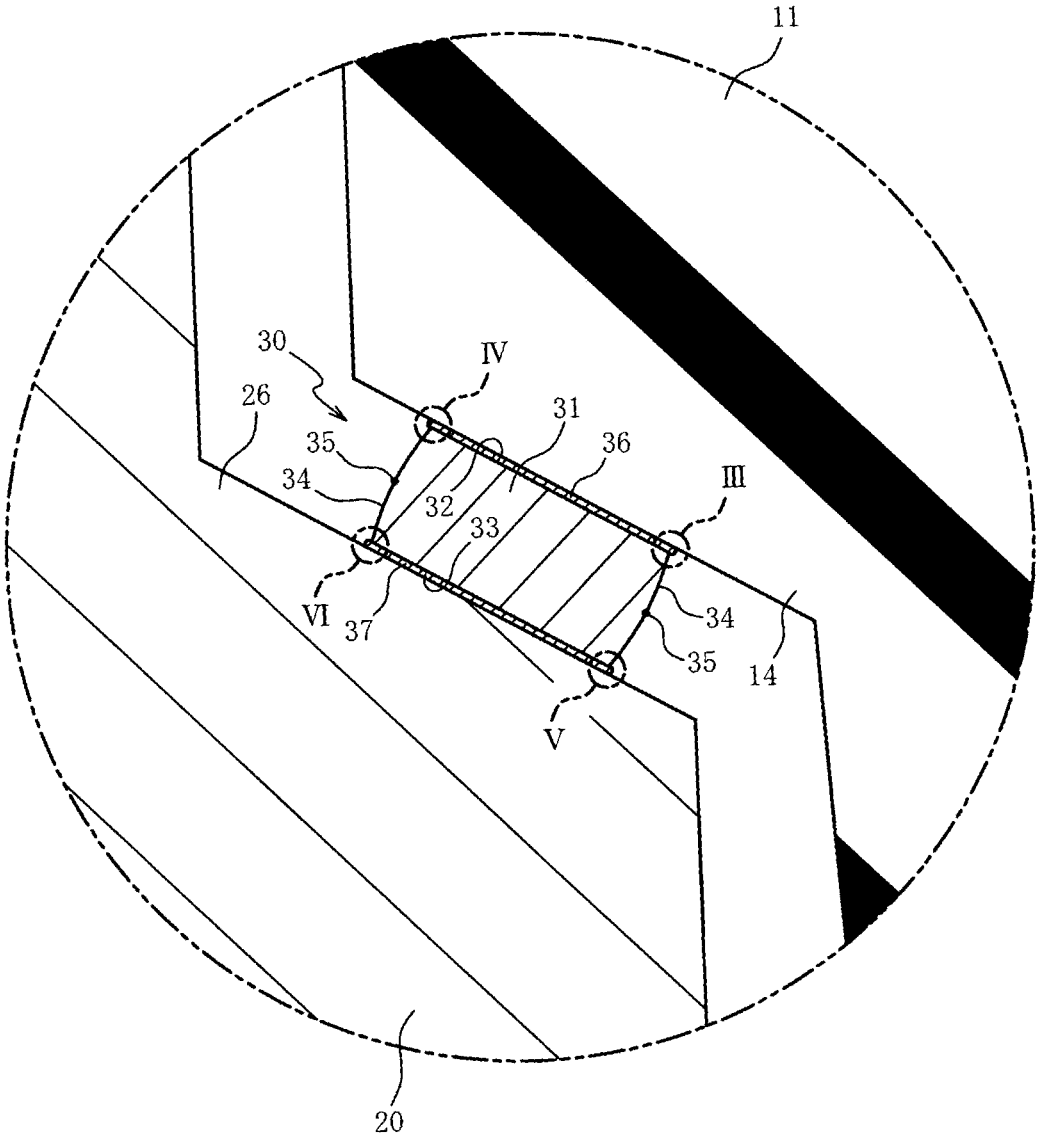
FIG. 2 is a partially enlarged sectional view of the spark plug at part indicated by II in FIG. 1.

Hereinafter, preferred embodiments of the present invention will be described with reference to the accompanying drawings. FIG. 1 is a half-sectional view of a spark plug 10 according to the first embodiment, with an axial line O as a boundary. FIG. 2 is a partially enlarged sectional view of the spark plug 10 at part indicated by II in FIG. 1. In FIG. 1, the lower side on the drawing sheet is referred to as a front side of the spark plug 10, and the upper side on the drawing sheet is referred to as a rear side of the spark plug 10 (the same applies in the other figures). As shown in FIG. 1, the spark plug 10 includes an insulator 11, a metal shell 20, and a packing 30.

The insulator 11 is a substantially cylindrical member made from, for example, alumina which is excellent in insulation property under high temperature and in mechanical property. The insulator 11 has an axial hole 12 extending along the axial line O. The insulator 11 has, almost at the center in the axial-line direction, an annular protruding portion 13 protruding radially outward. The insulator 11 has, on the front side with respect to the protruding portion 13, a step portion 14 (see FIG. 2) of which the outer diameter reduces toward the front side in the axial-line direction. A center electrode 15 is provided on the front side of the axial hole 12 of the insulator 11.

The center electrode 15 is a bar-shaped electrode held by the insulator 11 along the axial line O. The center electrode 15 is formed such that a core material having excellent thermal conductivity is embedded in a base material. The base material is formed from a metal material made of Ni or an alloy containing Ni as a main component, and the core material is formed from copper or an alloy containing copper as a main component. The core material may be omitted.

The center electrode 15 is electrically connected to a metal terminal 16 in the axial hole 12 of the insulator 11. The metal terminal 16 is a bar-shaped member to which a high-voltage cable (not shown) is connected, and is formed from a conductive metal material (e.g., low-carbon steel).

The metal shell 20 is a substantially cylindrical member formed from a conductive metal material (e.g., low-carbon steel). The metal shell 20 includes a front end portion 21 surrounding a part of the insulator 11 on the front side with respect to the protruding portion 13, a seat portion 23 contiguous to the rear side of the front end portion 21, a tool engagement portion 24 located on the rear side of the seat portion 23, and a rear end portion 25 contiguous to the rear side of the tool engagement portion 24. The front end portion 21 has, on the outer circumferential surface, an external thread 22 formed over almost the entire axial-line-direction length of the front end portion 21 and configured to be screwed into a screw hole of an engine (not shown). The front end portion 21 has, on the inner circumference thereof, a ledge portion 26 (see FIG. 2) of which the inner diameter reduces toward the front side in the axial-line direction.

The seat portion 23 is a part for restricting the screwed amount of the external thread 22 to the engine and closing a gap between the external thread 22 and the screw hole. The tool engagement portion 24 is a part with which a tool such as a wrench is to be engaged when the external thread 22 is screwed into the screw hole of the engine. The rear end portion 25 is an annular part bending toward the radially inner side. The rear end portion 25 is located on the rear side with respect to the protruding portion 13 of the insulator 11.

A ground electrode 27 is a bar-shaped member made of metal (e.g., nickel-based alloy) and connected to the front end portion 21 of the metal shell 20. The ground electrode 27 forms a spark gap between the ground electrode 27 and the center electrode 15. A seal portion 28 filled with powder of talc or the like is provided over the entire circumference between the protruding portion 13 of the insulator 11 and the rear end portion 25 of the metal shell 20.

As shown in FIG. 2, a packing 30 is interposed between the step portion 14 of the insulator 11 and the ledge portion 26 of the metal shell 20. The packing 30 includes a base material 31 and metal layers 36, 37 formed on surfaces of the base material 31. The base material 31 is an annular plate member made of a metal material such as iron or steel. The metal layers 36, 37 include a softer metal material such as Zn, Cu, Al, or Sn than the metal material forming the base material 31. The metal layers 36, 37 are formed on surfaces of the base material 31 by plating, spraying, vapor deposition, chemical treatment, or the like. As a matter of course, the metal layers 36, 37 may be provided in a multilayer form by performing chromate treatment on a surface of Zn, for example.

The metal layer 36 formed on a first surface 32 of the base material 31 contacts with the insulator 11, and the metal layer 37 formed on a second surface 33 on the side opposite to the first surface 32 contacts with the metal shell 20. In the present embodiment, the packing 30 is formed by stamping, in an annular shape, a zinc-plated steel plate on which chromate treatment has been performed. Therefore, no metal layers are formed on third surfaces 34 connecting the first surface 32 and the second surface 33.

In a process for manufacturing the spark plug 10, the metal shell 20 is attached to the insulator 11 with the packing 30 located between the ledge portion 26 of the metal shell 20 and the step portion 14 of the insulator 11. A part from the ledge portion 26 to the rear end portion 25 of the metal shell 20 applies an axial-line-direction compressive load to a part from the step portion 14 to the protruding portion 13 of the insulator 11 via the packing 30 and the seal portion 28. As a result, the metal shell 20 holds the insulator 11, and an axial-line-direction compressive load is applied to the packing 30.

Figure 3:
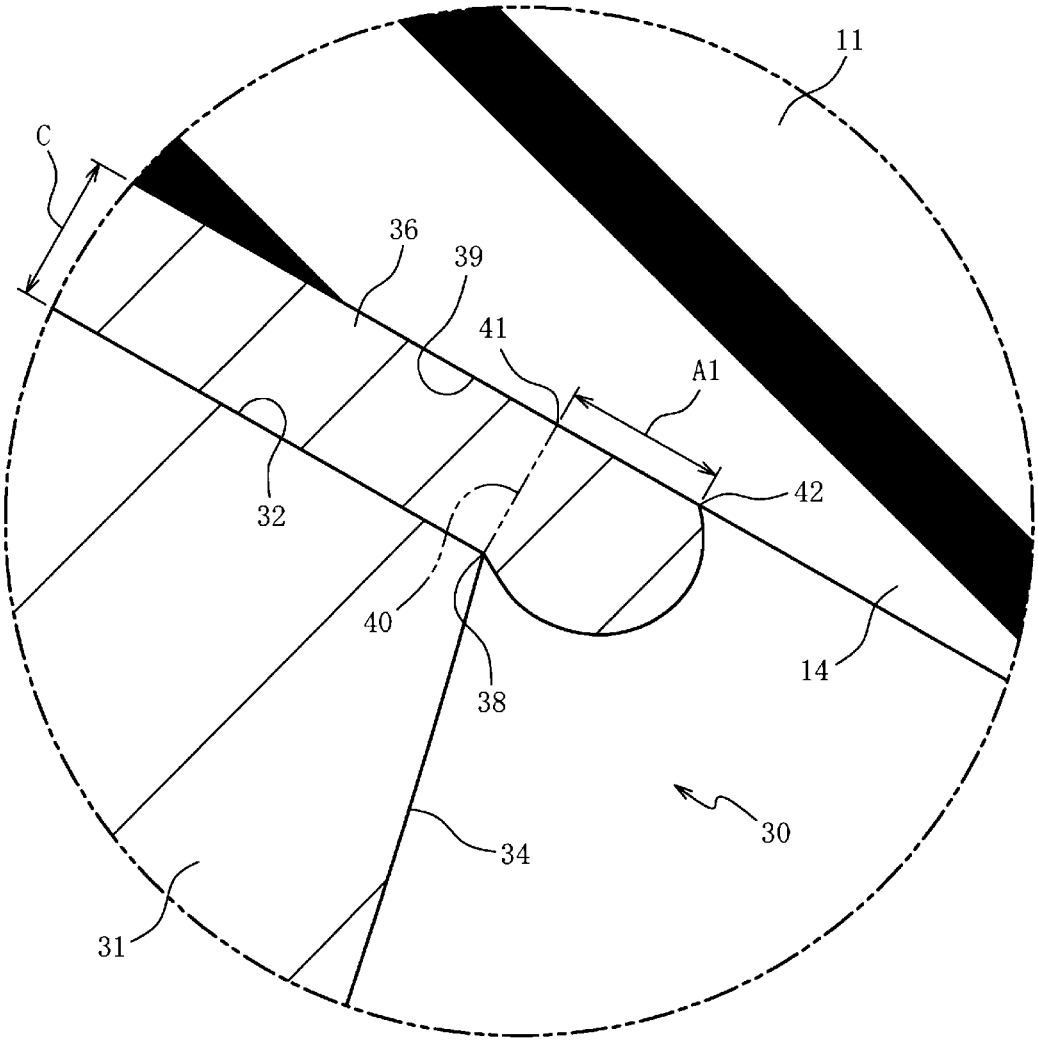
FIG. 3 is a partially enlarged sectional view of the spark plug at part indicated by III in FIG. 2.
Figure 4:
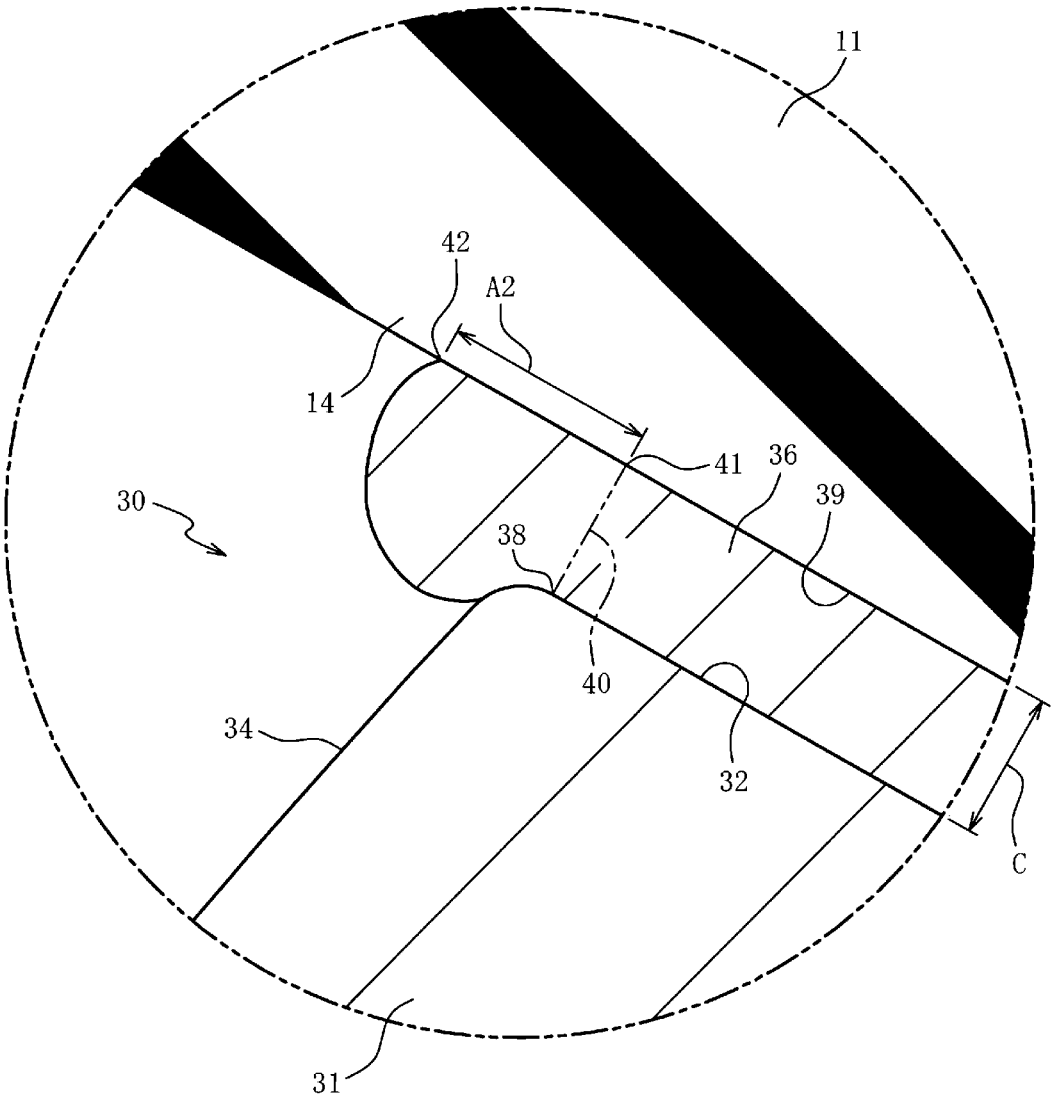
FIG. 4 is a partially enlarged sectional view of the spark plug at part indicated by IV in FIG. 2.
Figure 5:
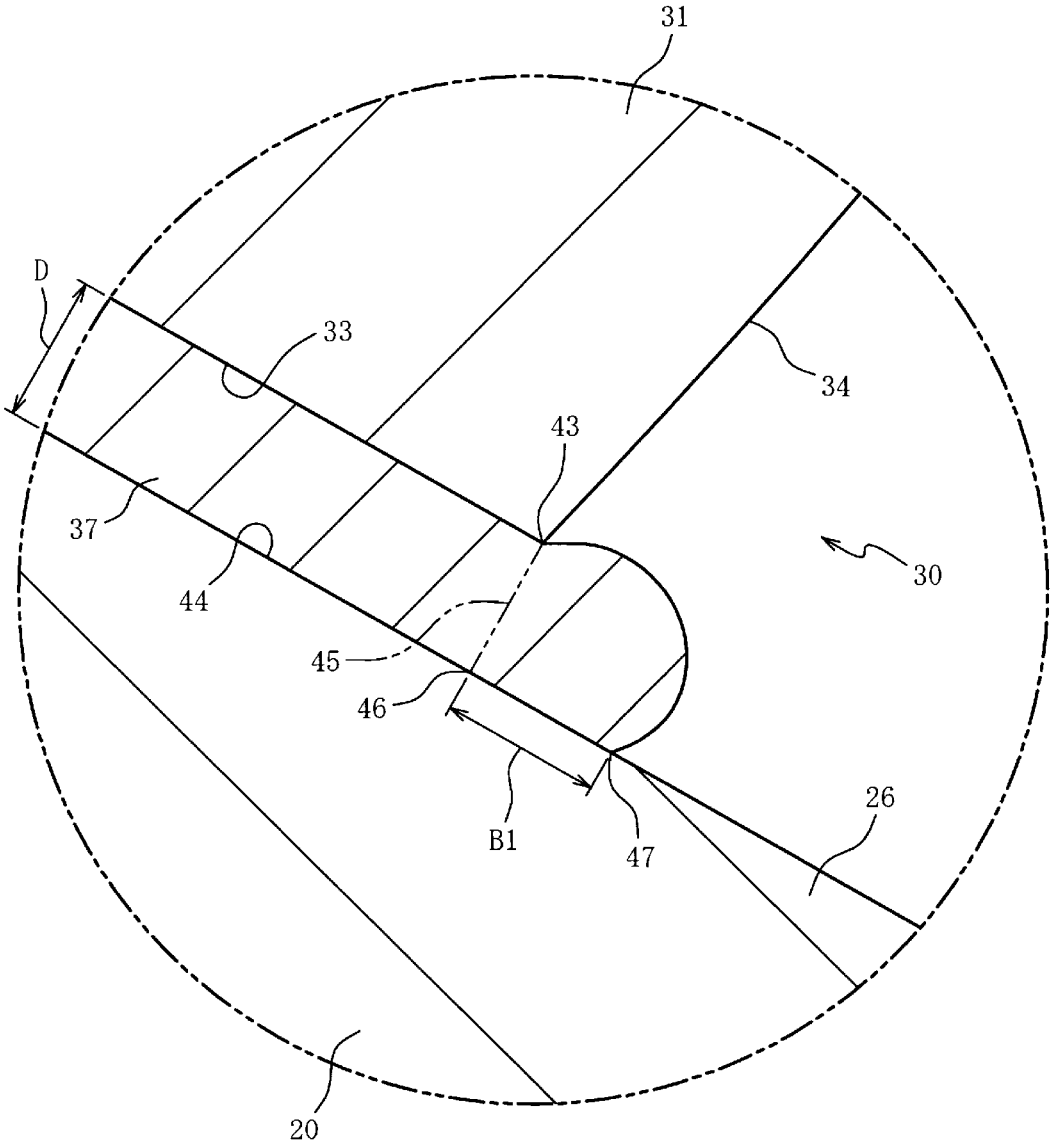
FIG. 5 is a partially enlarged sectional view of the spark plug at part indicated by V in FIG. 2.
Figure 6:
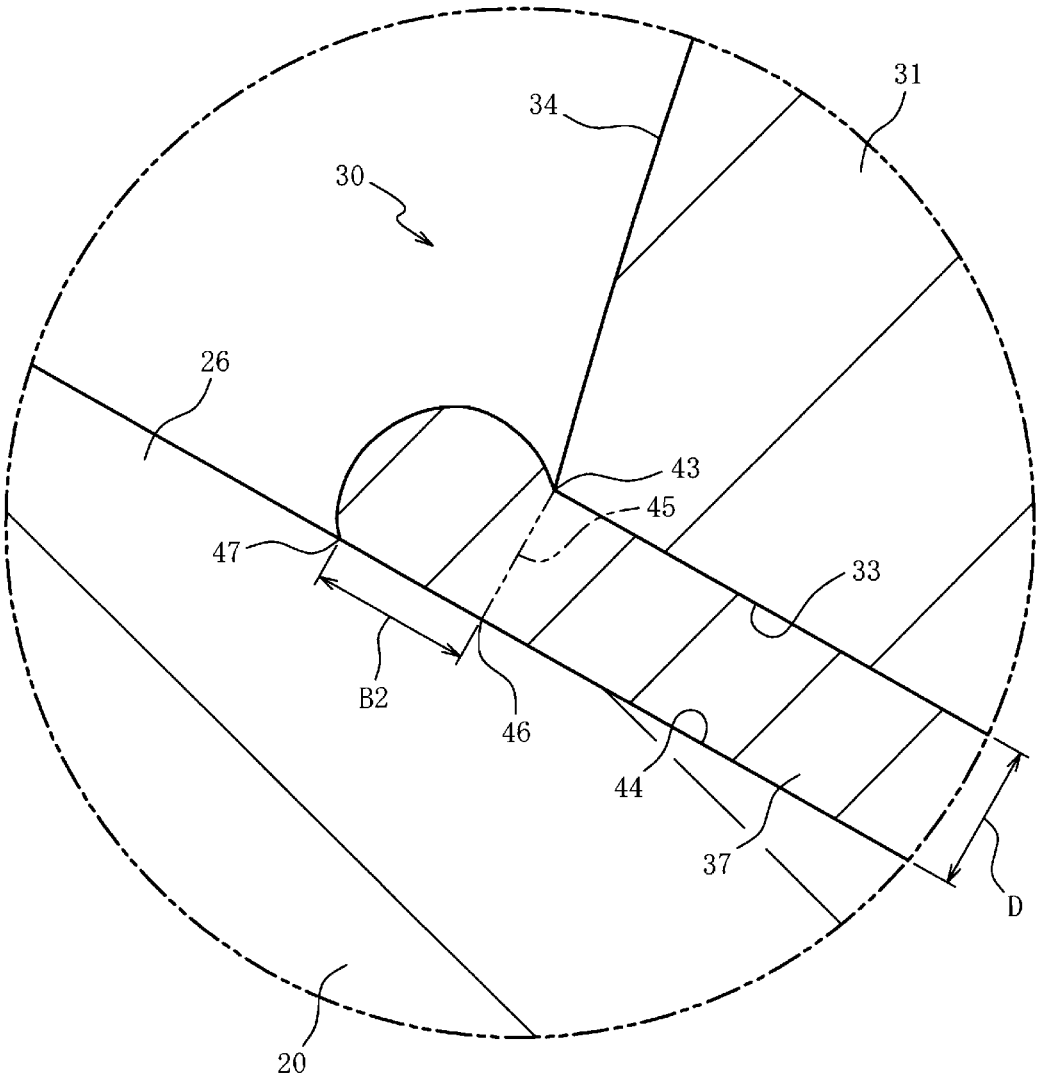
FIG. 6 is a partially enlarged sectional view of the spark plug at part indicated by VI in FIG. 2.

FIG. 3 is a partially enlarged sectional view including the axial line O of the spark plug 10 at part indicated by III in FIG. 2. FIG. 4 is a partially enlarged sectional view including the axial line O of the spark plug 10 at part indicated by IV in FIG. 2. FIG. 5 is a partially enlarged sectional view including the axial line O of the spark plug 10 at part indicated by V in FIG. 2. FIG. 6 is a partially enlarged sectional view of the spark plug 10 at part indicated by VI in FIG. 2.

As shown in FIG. 3 and FIG. 4, depending on the setting of the axial-line-direction load in attachment of the metal shell 20 to the insulator 11 and the setting of the thickness of the metal layer 36, the metal layer 36 which is softer than the base material 31 protrudes from the first surface 32 by being pressed between the step portion 14 of the insulator 11 and the first surface 32 of the base material 31. In the present embodiment, a part contacted by the metal layer 36 is kept within the outer circumferential surface of the step portion 14 of the insulator 11.

The lengths (distances) by which the metal layer 36 protrudes from the first surface 32 are represented by a distance A1 (see FIG. 3) and a distance A2 (see FIG. 4). A first perpendicular 40 is a perpendicular extending to a first contact surface 39 from a first corner 38 at which the first surface 32 and the third surface 34 of the base material 31 intersect each other. As shown in FIG. 4, in the case where a corner at which the first surface 32 and the third surface 34 intersect each other is chamfered (rounded), the first corner 38 as a start point of the first perpendicular 40 is an end point of the straight part of the first surface 32.

The first contact surface 39 is a surface of the insulator 11 that contacts with the metal layer 36. A first point 41 is the intersection of the first contact surface 39 and the first perpendicular 40. Of the distances between the first points 41 and end points 42 of the metal layer 36 on the first contact surface 39, a shorter distance positioned on the front side in the axial-line direction is defined as distance A1 (see FIG. 3). Similarly, of the distances between the first points 41 and the end points 42, a shorter distance positioned on the rear side in the axial-line direction is defined as distance A2 (see FIG. 4).

There is one first point 41 at each of the front side and the rear side in the axial-line direction, and also there is one end point 42 at each of the front side and the rear side in the axial-line direction. Therefore, of the distances between the first points 41 and the end points 42, the distance between the end point 42 closer to the first point 41, and the first point 41, is shorter, and the distance between the end point 42 farther from the first point 41, and the first point 41, is longer. Thus, of the distances between the first points 41 and the end points 42, the shorter distance refers to the distance between the end point 42 closer to the first point 41, and the first point 41.

The distance A1 is longer than the thickness of the metal layer in a direction perpendicular to the first perpendicular 40 at a middle position 35 (see FIG. 2) on the third surface 34 that corresponds to half the length measured along the third surface 34 from the first corner 38 of the base material 31 at which the distance A1 is measured, to a second corner 43 at which the second surface 33 (see FIG. 5) and the third surface 34 intersect each other. In the present embodiment, since there are no metal layers at the middle position 35 on the third surface 34, the thickness of the metal layer at the middle position 35 is zero. Since the distance A1 is longer than the thickness of the metal layer at the middle position 35, the area of the metal layer 36 that contacts with the insulator 11 becomes larger accordingly.

The thermal resistance of the metal layer 36 is proportional to the thickness of the metal layer 36 and inversely proportional to the area and the thermal conductivity of the metal layer 36. Therefore, by increasing the area of the metal layer 36 that contacts with the insulator 11, it is possible to reduce the thermal resistance of the packing 30 without changing the thickness or the thermal conductivity of the packing 30. When the thermal resistance of the packing 30 is small, the amount of heat flow transferring from the insulator 11 through the packing 30 to the metal shell 20 can be increased even if the temperature difference between the insulator 11 and the metal shell 20 is not changed. As a result, occurrence of pre-ignition in which the insulator 11 acts as an ignition source can be prevented.

The distance A1 is longer than a distance C between the first surface 32 of the base material 31 and the insulator 11. Since the distance C is shorter than the distance A1, the thermal conductivity of the metal layer 36 can be expected to be improved owing to reduction in the thickness of the metal layer 36 between the first surface 32 of the base material 31 and the insulator 11 and decrease of voids and the like included in the metal layer 36. Since the thermal resistance of the metal layer 36 is proportional to the thickness of the metal layer 36 and inversely proportional to the thermal conductivity of the metal layer 36, if the distance C is shorter than the distance A1, the thermal resistance of the packing 30 can be further reduced. It is noted that the distance C is the shortest one of distances between the first surface 32 of the base material 31 and the insulator 11.

The distance A2 is longer than the thickness of the metal layer in a direction perpendicular to the first perpendicular 40 at a middle position 35 (see FIG. 2) on the third surface 34 that corresponds to half the length measured along the third surface 34 from the first corner 38 of the base material 31 at which the distance A2 is measured, to the second corner 43. In the present embodiment, the thickness of the metal layer at the middle position 35 is zero. Since the distance A2 is longer than the thickness of the metal layer at the middle position 35, the area of the metal layer 36 that contacts with the insulator 11 becomes larger accordingly. Therefore, as in the case where the distance A1 is longer, the thermal resistance of the packing 30 can be reduced.

The distance A2 is longer than the distance C between the first surface 32 of the base material 31 and the insulator 11. Therefore, as in the case where the distance A1 is longer than the distance C, the thermal resistance of the packing 30 can be further reduced.

In particular, in the case of the spark plug 10 in which the nominal diameter of the external thread 22 of the metal shell 20 is not greater than 12 mm, the radial-direction length of the step portion 14 of the insulator 11 held by the metal shell 20 is short, and therefore the areas of the first surface 32 and the second surface 33 of the base material 31 of the packing 30 are narrowed. This works against reduction in the thermal resistance of the packing 30. However, if at least one of the distances A1, A2 is set to be longer than the thickness of the metal layer at the middle position 35, the area of the metal layer 36 can be increased accordingly, whereby it is possible to reduce the thermal resistance of the packing 30 even in the case of the spark plug 10 in which the nominal diameter of the external thread 22 is not greater than 12 mm.

As shown in FIG. 5 and FIG. 6, depending on the setting of the axial-line-direction load in attachment of the metal shell 20 to the insulator 11 and the setting of the thickness of the metal layer 37, the metal layer 37 which is softer than the base material 31 protrudes from the second surface 33 by being pressed between the ledge portion 26 of the metal shell 20 and the second surface 33 of the base material 31. In the present embodiment, a part contacted by the metal layer 37 is kept within the inner circumferential surface of the ledge portion 26 of the metal shell 20.

The lengths (distances) by which the metal layer 37 protrudes from the second surface 33 are represented by a distance B1 (see FIG. 5) and a distance B2 (see FIG. 6). A second perpendicular 45 is a perpendicular extending to a second contact surface 44 from the second corner 43 at which the second surface 33 and the third surface 34 of the base material 31 intersect each other. In the case where a corner at which the second surface 33 and the third surface 34 intersect each other is chamfered (rounded), as in FIG. 4, the second corner 43 as a start point of the second perpendicular 45 is an end point of the straight part of the second surface 33.

The second contact surface 44 is a surface of the metal shell 20 that contacts with the metal layer 37. A second point 46 is the intersection of the second contact surface 44 and the second perpendicular 45. Of the distances between the second points 46 and end points 47 of the metal layer 37 on the second contact surface 44, the shorter distance positioned on the front side in the axial-line direction is defined as distance B1 (see FIG. 5). Similarly, of the distances between the second points 46 and the end points 47, the shorter distance positioned on the rear side in the axial-line direction is defined as distance B2 (see FIG. 6).

There is one second point 46 at each of the front side and the rear side in the axial-line direction, and also there is one end point 47 at each of the front side and the rear side in the axial-line direction. Therefore, of the distances between the second points 46 and the end points 47, the distance between the end point 47 closer to the second point 46, and the second point 46, is shorter, and the distance between the end point 47 farther from the second point 46, and the second point 46, is longer. Thus, of the distances between the second points 46 and the end points 47, the shorter distance refers to the distance between the end point 47 closer to the second point 46, and the second point 46.

The distance B1 is longer than the thickness of the metal layer in a direction perpendicular to the second perpendicular 45 at the middle position 35 (see FIG. 2) on the third surface 34 that corresponds to half the length measured along the third surface 34 from the second corner 43 of the base material 31 at which the distance B1 is measured, to the first corner 38 (see FIG. 3). In the present embodiment, the thickness of the metal layer at the middle position 35 is zero. Since the distance B1 is longer than the thickness of the metal layer at the middle position 35, the area of the metal layer 37 that contacts with the metal shell 20 becomes larger accordingly. Thus, the thermal resistance of the packing 30 can be reduced.

The distance B1 is longer than a distance D between the second surface 33 of the base material 31 and the metal shell 20. Since the distance D is shorter than the distance B1, the thermal conductivity of the metal layer 37 can be expected to be improved owing to reduction in the thickness of the metal layer 37 between the second surface 33 of the base material 31 and the metal shell 20 and decrease of voids and the like included in the metal layer 37. Since the thermal resistance of the metal layer 37 is proportional to the thickness of the metal layer 37 and inversely proportional to the thermal conductivity of the metal layer 37, if the distance D is shorter than the distance B1, the thermal resistance of the packing 30 can be further reduced. It is noted that the distance D is the shortest one of distances between the second surface 33 of the base material 31 and the metal shell 20.

The distance B2 is longer than the thickness of the metal layer in a direction perpendicular to the second perpendicular 45 at the middle position 35 (see FIG. 2) on the third surface 34 that corresponds to half the length measured along the third surface 34 from the second corner 43 of the base material 31 at which the distance B2 is measured, to the first corner 38 (see FIG. 4). In the present embodiment, the thickness of the metal layer at the middle position 35 is zero. Since the distance B2 is longer than the thickness of the metal layer at the middle position 35, the area of the metal layer 37 that contacts with the metal shell 20 becomes larger accordingly. Therefore, as in the case where the distance B1 is longer, the thermal resistance of the packing 30 can be reduced.

The distance B2 is longer than the distance D between the second surface 33 of the base material 31 and the metal shell 20. Therefore, as in the case where the distance B1 is longer than the distance D, the thermal resistance of the packing 30 can be further reduced.

Figure 7:
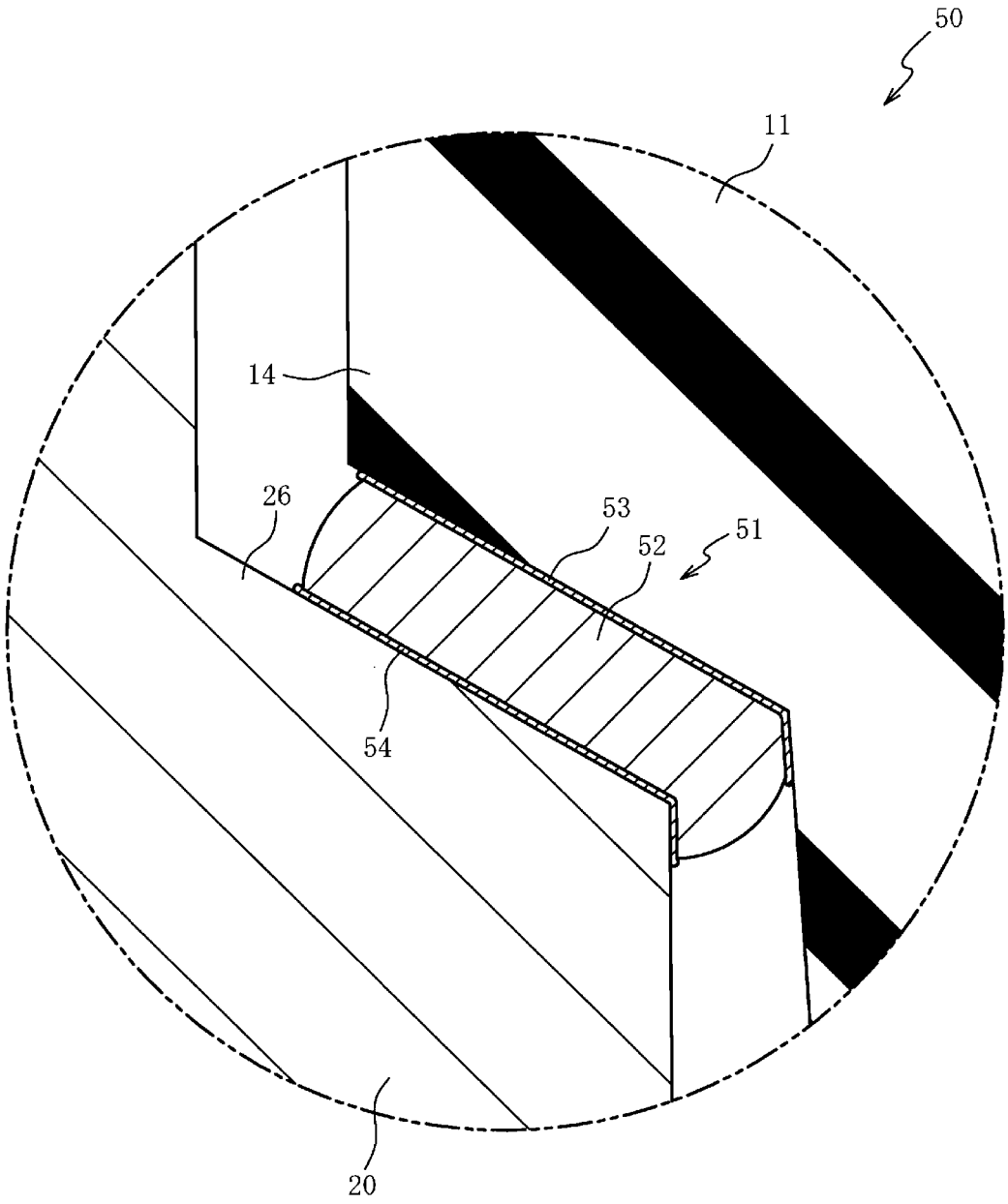
FIG. 7 is a partially enlarged sectional view of a spark plug according to the second embodiment.

With reference to FIG. 7, the second embodiment will be described. In the first embodiment, the case where a part contacted by the metal layer 36 is kept within the outer circumferential surface of the step portion 14 of the insulator 11, and a part contacted by the metal layer 37 is kept within the inner circumferential surface of the ledge portion 26 of the metal shell 20, has been described. On the other hand, in the second embodiment, the case where a metal layer 53 of a packing 51 contacts with a part other than the step portion 14 of the insulator 11 and a metal layer 54 of the packing 51 contacts with a part other than the ledge portion 26 of the metal shell 20, will be described. The same parts as those described in the first embodiment are denoted by the same reference characters and description thereof will not be repeated below. FIG. 7 is a partial sectional view including the axial line O of a spark plug 50 according to the second embodiment, and as in FIG. 2, the part indicated by II in FIG. 1 is shown in an enlarged manner.

In the spark plug 50, the insulator 11 is held by the metal shell 20 in a state in which the step portion 14 of the insulator 11 is engaged with the ledge portion 26 of the metal shell 20 via the packing 51. The packing 51 includes an annular base material 52 made of metal, and metal layers 53, 54 formed on surfaces of the base material 52. The metal layers 53, 54 are formed from a metal material softer than the base material 52. In the present embodiment, the packing 51 is formed by stamping, in an annular shape, a zinc-plated steel plate on which chromate treatment has been performed.

The packing 51 is deformed by an axial-line-direction load in attachment of the metal shell 20 to the insulator 11. The metal layer 53 contacts with the step portion 14 and a part of the insulator 11 on the front side with respect to the step portion 14. The metal layer 54 contacts with the ledge portion 26 and a part of the metal shell 20 on the front side with respect to the ledge portion 26. Since the metal layer 53 is softer than the base material 52, breakage of the insulator 11 due to the metal layer 53 contacting with the part on the front side with respect to the step portion 14 can be prevented.

Also in the second embodiment in which the metal layer 53 of the packing 51 contacts with a part other than the step portion 14 of the insulator 11 and the metal layer 54 of the packing 51 contacts with a part other than the ledge portion 26 of the metal shell 20, the distances A1, A2, B1, B2, C, D of the spark plug 50 are set in the same manner as in the first embodiment. Therefore, also in the second embodiment, the thermal resistance of the packing 51 can be reduced.

Although the present invention has been described with reference to the embodiments, the present invention is not limited to the above embodiments at all. It can be easily understood that various modifications can be devised without departing from the gist of the present invention.

In the above embodiments, the packing 30, 51 is formed by stamping, in an annular shape, a plated steel plate of which both surfaces are plated. Therefore, the metal layer 36, 53 is formed on the first surface 32 of the base material 31, 52, the metal layer 37, 54 is formed on the second surface 33, and no metal layers are formed on the third surfaces 34. However, the present invention is not limited thereto. Even in the case where the packing has metal layers on the third surfaces 34 of the base material 31, 52, if at least one of the distances A1, A2 is longer than the thickness of the metal layer at the middle position 35 on the third surface 34, the area of the metal layer 36, 53 can be increased accordingly, so that the same effects as in the above embodiments can be obtained.

The packing having metal layers on the third surfaces 34 of the base material 31, 52 can be formed by shaping the base material 31, 52 into an annular shape and then performing barrel plating (electro plating or electroless plating)

thereon. With this method, a metal layer can be formed on the entire surface of the base material 31, 52. The material of the metal layer is not limited to Zn.

In the above embodiments, the case where both of the distances A1, A2 are longer than the thicknesses of the metal layers at the middle positions 35 on the third surfaces 34, has been described. However, the present invention is not necessarily limited thereto. As long as at least one of the distances A1, A2 is longer than the thickness of the metal layer at the middle position 35 on the third surface 34, the area of the metal layer 36, 53 can be increased accordingly, and thus the thermal resistance of the packing 30, 51 can be reduced.

In the above embodiments, the case where both of the distance B1, B2 are longer than the thicknesses of the metal layers at the middle positions 35 on the third surfaces 34, has been described above. However, the present invention is not necessarily limited thereto. As long as at least one of the distance B1, B2 is longer than the thickness of the metal layer at the middle position 35 on the third surface 34, the area of the metal layer 37, 54 can be increased accordingly, and thus the thermal resistance of the packing 30, 51 can be reduced.

In the second embodiment, the case where the metal layer 53 contacting with the step portion 14 of the insulator 11 contacts with a part of the insulator 11 on the front side with respect to the step portion 14, has been described. However, the present invention is not necessarily limited thereto. Even in the case where the metal layer 53 contacting with the step portion 14 of the insulator 11 contacts with a part of the insulator 11 on the rear side with respect to the step portion 14, as long as at least one of the distances A1, A2 is set as in the first embodiment, the same effects as in the embodiment can be obtained.

In the second embodiment, the case where the metal layer 54 contacting with the ledge portion 26 of the metal shell 20 contacts with a part of the metal shell 20 on the front side with respect to the ledge portion 26, has been described. However, the present invention is not necessarily limited thereto. Even in the case where the metal layer 54 contacting with the ledge portion 26 of the metal shell 20 contacts with a part of the metal shell 20 on the rear side with respect to the ledge portion 26, as long as at least one of the distances B1, B2 is set as in the first embodiment, the same effects as in the embodiment can be obtained.

In the above embodiments, the case where the rear end portion 25 of the metal shell 20 applies an axial-line-direction load to the protruding portion 13 of the insulator 11 via the seal portion 28, has been described. However, the present invention is not necessarily limited thereto. Also in the case where the rear end portion 25 of the metal shell 20 applies an axial-line-direction load to the protruding portion 13 of the insulator 11 without the seal portion 28, the same effects as in the embodiments can be obtained.

What is claimed is:

1. A spark plug comprising:

an insulator extending along an axial line from a front side to a rear side and having a step portion of which an outer diameter reduces toward the front side in the axial-line direction; and a cylindrical metal shell having, on an inner circumference thereof, a ledge portion of which an inner diameter reduces toward the front side in the axial-line direction, the metal shell holding the insulator from an outer circumferential side in a state in which the step portion is engaged with the ledge portion via a packing, wherein the packing includes a base material, and a metal layer formed on a surface of the base material and contacting with the insulator and the metal shell, the base material includes a first surface where a part of the metal layer that contacts with the insulator is formed, a second surface on a side opposite to the first surface, and third surfaces connecting the first surface and the second surface, and in a cross section including the axial line, of distances between end points of the metal layer on a first contact surface of the insulator that contacts with the metal layer and first points which are intersections of the first contact surface and first perpendiculars extending to the first contact surface from first corners at which the first surface and the third surfaces intersect each other, a shorter distance positioned on the front side in the axial-line direction is defined as distance A1, and a shorter distance positioned on the rear side in the axial-line direction is defined as distance A2, and at least one of the distance A1 and the distance A2 is longer than a thickness of the metal layer in a direction perpendicular to the first perpendicular at a middle position on the third surface that corresponds to half a length measured along the third surface from the first corner to a second corner at which the second surface and the third surface intersect each other, on a side where the corresponding one of the distance A1 and the distance A2 is measured.

2. The spark plug according to claim 1, wherein in the cross section including the axial line, at least one of the distance A1 and the distance A2 is longer than a distance C between the first surface and the first contact surface.

3. The spark plug according to claim 1, wherein of the metal layer, a part contacting with the metal shell is formed at the second surface, and in the cross section including the axial line, of distances between end points of the metal layer on a second contact surface of the metal shell that contacts with the metal layer and second points which are intersections of the second contact surface and second perpendiculars extending from the second corner to the second contact surface, a shorter distance positioned on the front side in the axial-line direction is defined as distance B1, and a shorter distance positioned on the rear side in the axial-line direction is defined as distance B2, and at least one of the distance B1 and the distance B2 is longer than a thickness of the metal layer in a direction perpendicular to the second perpendicular at the middle position on a side where the corresponding one of the distance B1 and the distance B2 is measured.

4. The spark plug according to claim 3, wherein in the cross section including the axial line, at least one of the distance B1 and the distance B2 is longer than a distance D between the second surface and the second contact surface.

* * * * *